US006942405B1

(12) United States Patent
Chi et al.

(10) Patent No.: US 6,942,405 B1
(45) Date of Patent: Sep. 13, 2005

(54) PRINTER SYSTEM INCLUDING GUIDE PLATE FOR GUIDING PRINT RIBBON DURING PRINTING AND GUIDING DOCUMENT DURING SCANNING

(75) Inventors: Hye S. Chi, Raleigh, NC (US); Robert Andrew Myers, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/841,917

(22) Filed: May 7, 2004

(51) Int. Cl.[7] ..... B41J 13/042; B41J 35/04
(52) U.S. Cl. ..... 400/636; 400/248; 400/642
(58) Field of Search ..... 400/73, 247, 248, 400/578, 636, 642; 235/379

(56) References Cited

U.S. PATENT DOCUMENTS 4,589,784 A 5/1986 Valle et al.
5,634,729 A * 6/1997 Kinney et al. ..... 400/73
5,867,585 A * 2/1999 Myers ..... 382/139
5,893,667 A 4/1999 Kinney et al.
6,126,072 A 10/2000 Martinez et al.

* cited by examiner

*Primary Examiner*—Leslie J. Evanisko
(74) *Attorney, Agent, or Firm*—Sawyer Law Group LLP; Jeanine Ray-Yarletts

(57) ABSTRACT

A printer system is disclosed. The printer system includes a frame, at least one feed roll shaft coupled to the frame for feeding a document through the printer system, and a reference plate rotatably attached to the at least one feed roll shaft. The reference plate includes a first surface for facilitating scanning functions and a second surface for facilitating printing functions. According to the system and method disclosed herein, printing and scanning mechanisms are optimally integrated in a compact space by utilizing a multi-purpose reference plate.

21 Claims, 4 Drawing Sheets

100

100

100

PRINTER SYSTEM INCLUDING GUIDE PLATE FOR GUIDING PRINT RIBBON DURING PRINTING AND GUIDING DOCUMENT DURING SCANNING

RELATED CO-PENDING PATENT APPLICATIONS

The present invention is related to a co-pending U.S. application Ser. No. 10/633,958, filed on Aug. 4, 2003, and entitled "Document Feeder Device," and to a co-pending U.S. application, Ser. No. 10/843,164, filed May 11, 2004, and entitled "Document Feeder with Roller Adjustment Device."

FIELD OF THE INVENTION

The present invention relates to printers, and more particularly to a printer system that integrates various functions in a compact space.

BACKGROUND OF THE INVENTION

Printers are well known and are used to print documents onto loose, single sheets of paper. Point-of-sale printers are printers typically used in business transactions and include functions such as printing receipts or printing on preprinted documents, such as on personal checks.

New functions continue to be integrated into point-of-sale printers in order to minimize clutter, reduce footprints, and increase operational efficiency. In order to complete document-processing functions as quickly as possible, some conventional solutions combine printing and scanning functions. A problem with these existing conventional solutions is that documents can get misfed when documents transition from the print area to the scan area.

Some conventional solutions physically locate various mechanisms as close a possible. A problem, however, with existing solutions is that it may be difficult to provide maintenance (e.g., cleaning, repairs), because the various mechanisms may be too close together, making access to the various mechanisms difficult.

Another conventional solution is to include an optical sensor to detect the location of a document being printed or scanned. However, the additional scanning mechanism requires additional software and hardware, increases cost and complexity of the printer, as well as increases clutter within the printer.

Disadvantages of many of the above-described and other known arrangements include increased clutter within a printer and the requirement of both additional hardware, software, and the possible misfeeding of documents transitioning from the print area to the scan area.

Accordingly, what is needed is an improved printer system that integrates various printer functions without the above-described problems. The system and method should be simple, cost effective and capable of being easily adapted to existing technology. The present invention addresses such a need.

SUMMARY OF THE INVENTION

A printer system is disclosed. The printer system comprises a frame, at least one feed roll shaft coupled to the frame for feeding a document through the printer system, and a reference plate rotatably attached to the at least one feed roll shaft. The reference plate comprises a first surface for facilitating scanning functions and a second surface for facilitating printing functions. According to the system and method disclosed herein, printing and scanning mechanisms are optimally integrated in a compact space by utilizing a multi-purpose reference plate.

DETAILED DESCRIPTION OF THE INVENTION

The present invention relates to printers, and more particularly to a printer system that integrates various functions in a compact space. The following description is presented to enable one of ordinary skill in the art to make and use the invention, and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

A system in accordance with the present invention for providing a printer system is disclosed. The printer system comprises printing and scanning functions and integrates these functions by utilizing a multi-function reference plate. The printing system comprises a frame, at least one feed roll shaft coupled to the frame for feeding a document through the printer system, and a reference plate rotatably attached to the feed roll shaft. The reference plate comprises a scan surface for facilitating scanning functions and a ribbon surface for facilitating printing functions. As a result, printing and scanning mechanisms are optimally integrated in a compact space by utilizing a multi-purpose reference plate. To more particularly describe the features of the present invention, refer now to the following description in conjunction with the accompanying figures.

Although the present invention disclosed herein is described in the context of point-of-sale printers, the present invention may apply to other types of printers and still remain within the spirit and scope of the present invention.

Figure 1:
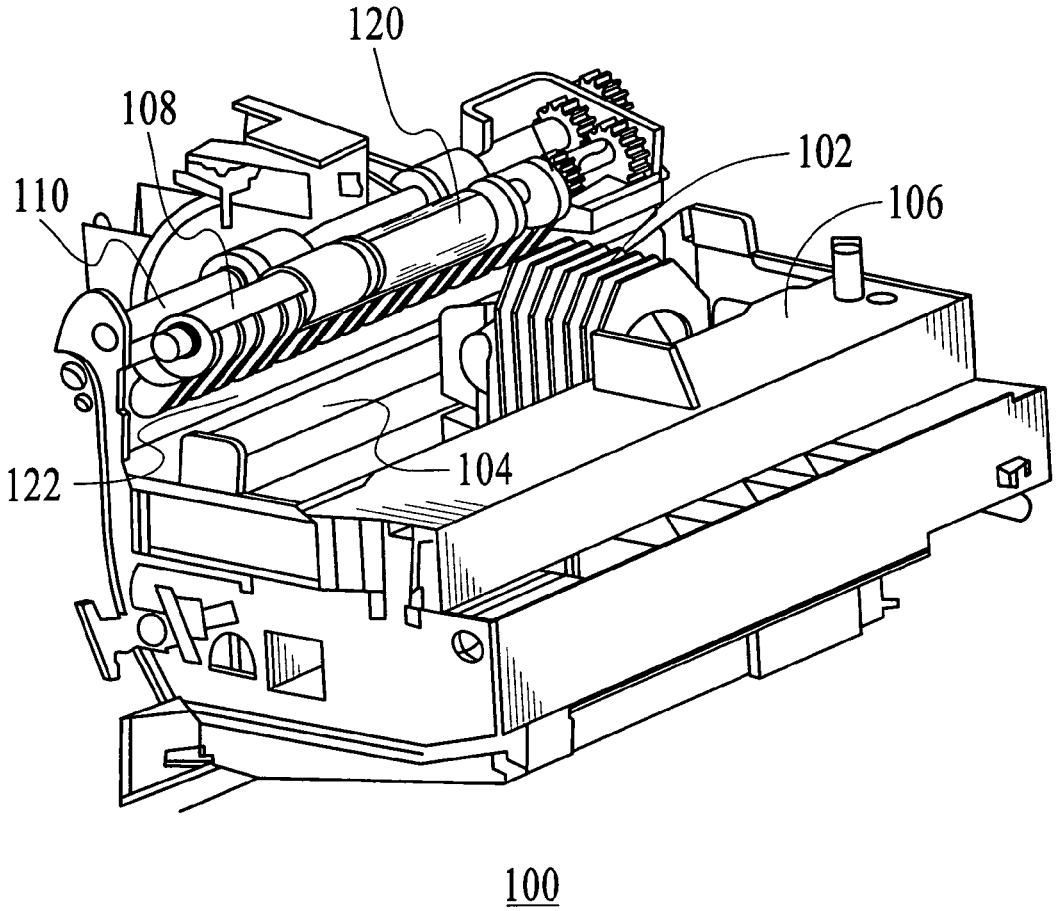
FIG. 1 is a perspective-view diagram of a printer system without a cover in accordance with the present invention.

FIG. 1 is a perspective-view diagram of a printer system 100 without a cover in accordance with the present invention. The printer system 100 comprises a printhead 102 positioned at a print line 104 (also referred to as a print surface) and a ribbon 106 for printing onto a document or sheet. For ease of discussion, the terms document and sheet are used interchangeably. A document can be a blank sheet or a pre-printed sheet. Alternatively, a document can be a multi-part or multi-ply form, with or without carbon paper. A sheet is typically made of paper but is not limited to paper. The printer system 100 also comprises feed roll shafts 108 and 110 for feeding a document through the printer system 100.

The printer system 100 also comprises a reference plate 120 (also referred to as a calibration plate) that is coupled to the feed roll shaft 108 and a scanner 122. In this specific embodiment, the scanner 122 is an optical scanner and can scan a document to determine its position. The scanner 122 can also provide optical character recognition and retain images of a document, such as magnetic characters on a personal check.

Figure 2:
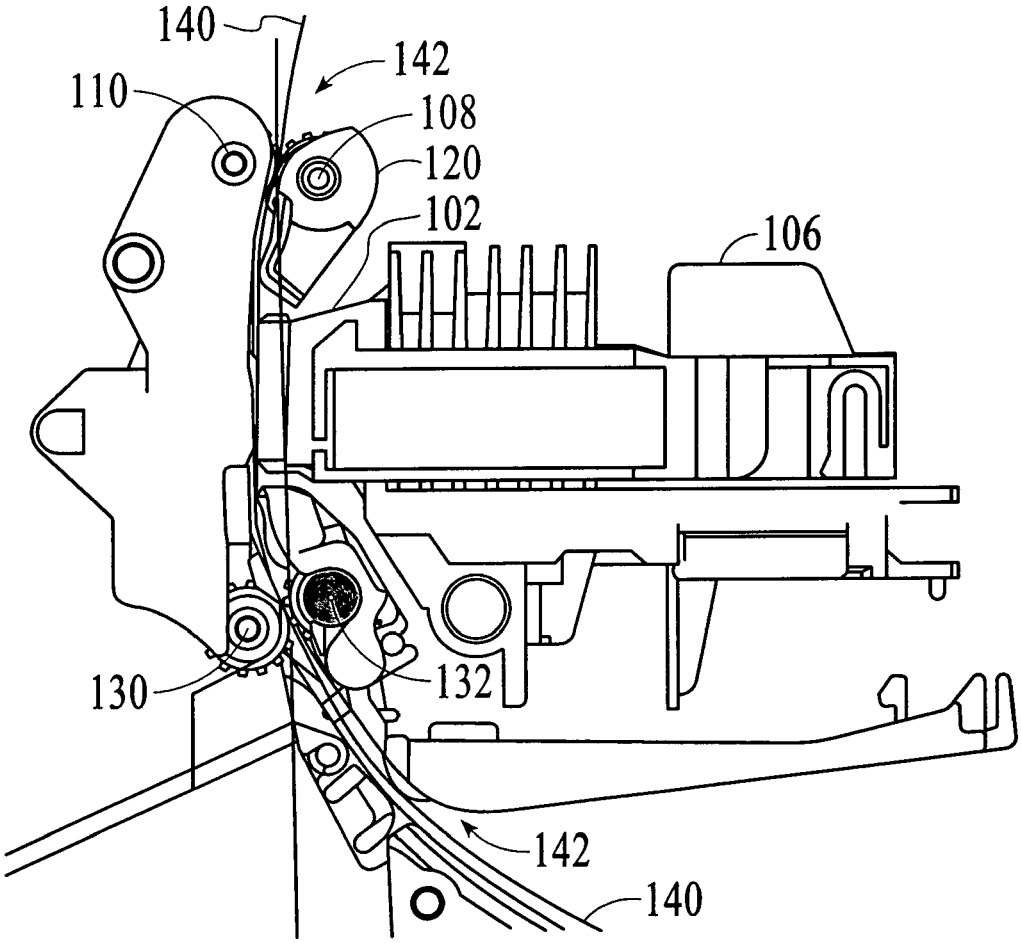
FIG. 2 is a detailed side-view diagram of the printer system of FIG. 2, including the reference plate in accordance with the present invention.

The reference plate 120 serves multiple functions to facilitate scanning and printing operations of the printer system 100. The functions of the reference plate 120 are described in more detail below in FIGS. 2–4. FIG. 2 is a detailed side-view diagram of the printer system 100 of FIG. 2, including the reference plate 120 in accordance with the present invention. Also shown are the printhead 102, the ribbon 106, and the feed roll shafts 108 and 110, and a second pair of feed roll shafts 130 and 132. In this specific embodiment, the feed roll shafts 130 and 132 feed a document 140 through a document path 142. The feed roll shafts 108 and 110 also feed the document 140 through the document path 142, and also feed the document to the scanner 122, which is above the print line 104. The scanner 122 and the print line 104 are shown more clearly in FIG. 3.

Figure 3:
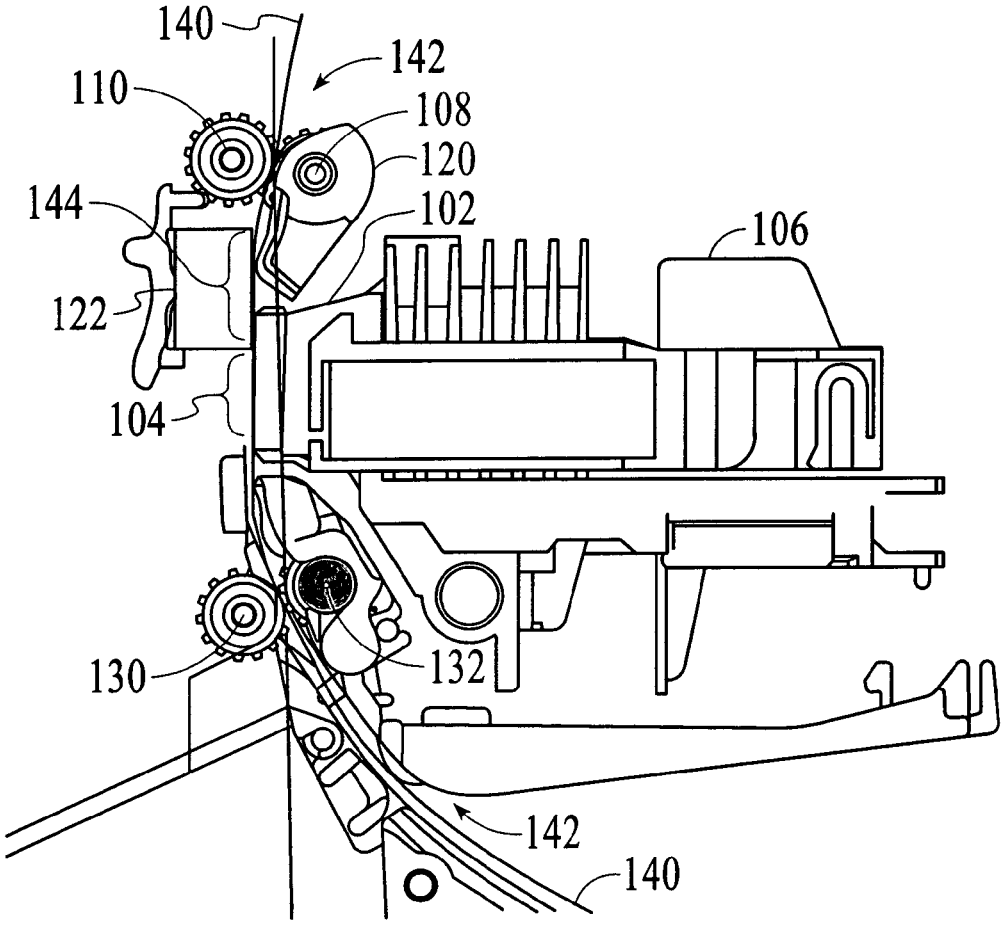
FIG. 3 is another detailed side-view diagram of the printer system of FIG. 2 with a portion of the frame removed to show the scanner in accordance with the present invention.

FIG. 3 is another detailed side-view diagram of the printer system 100 of FIG. 2 with a portion of the frame removed to show the scanner 122 in accordance with the present invention. Also shown is the print line 104 and a scan line 144 (also referred to as a scan area). Embodiments of the present invention locate the reference plate 120 as close as possible to the print line 104 (where the printhead 102 is located) and to the scan line 144 (where the reader of the scanner is located). This allows the entire process of scanning, decoding, and printing to be accomplished with a minimum amount of time and document motion. Because the document motion is minimized, the probability of a document being misfed is also minimized.

Figure 4:
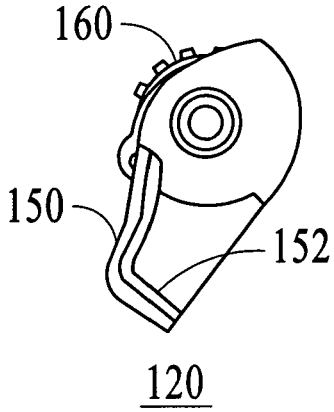
FIG. 4 is a side-view diagram of the reference plate of FIG. 2 in accordance with the present invention.

FIG. 4 is a side-view diagram of the reference plate 120 of FIG. 2 in accordance with the present invention. Referring to both FIGS. 3 and 4, the reference plate 120 provides multiple functions for printing and scanning operations. First, the reference plate 120 has a curvilinear shape at a scan surface 150 and at a ribbon surface 152 so that the reference plate 120 can function as a document guide during printing and scanning. More specifically, the curvilinear shape of the scan surface 150 provides a document guide, which guides a document from the print line 104 to and from the scan line 144, and provides a reliable entry point (also referred to as a lead-in surface). The curvilinear shape of the scan surface 150 also provides a contact point at the scan line 144 and provides a lead-out surface at the top of the printer system 100. This facilitates documents in reliably transitioning from the print line 104 to the scan line 144 and beyond while minimizing or eliminating misfeeds.

The reference plate 120 also functions as a ribbon-loading guide for printing. More specifically, the curvilinear shape of the ribbon surface 152 is opposite the scan surface 150 and guides a ribbon to and from the print line 104. As such, the reference plate 120 enables the ribbon to retain an intuitive "clean hands" installation in that the ribbon can be conveniently inserted into and out of the print area. Furthermore, because of the curvilinear shape, the ribbon 106 can be conveniently installed between the reference plate 120 and the tip of the printhead by an unskilled operator.

Second, the reference plate 120 utilizes a spring 160 to ensure contact between the document and the scanner, i.e., to keep the document flush against the scanner for proper scanning. In a specific embodiment, the spring 160 is a torsion spring, which is used to hold and apply pressure onto the reference plate 120. One embodiment of the spring is described in a co-pending U.S. application Ser. No. 10/843,164, filed May 11, 2004, and entitled "Document Feeder Device with Roller Adjustment Device," and is herein incorporated by reference.

Figure 5:
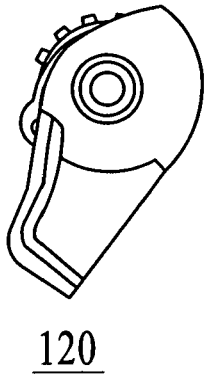
FIG. 5 is a side-view diagram of the reference plate of FIG. 2, where the reference plate has color and texture in accordance with the present invention.

Third, the reference plate 120 is colored and/or textured to provide a background surface that contrasts the document. FIG. 5 is a side-view diagram of the reference plate 120 of FIG. 2, where the reference plate 120 is colored and textured in accordance with the present invention. The colored and/or textured background surface facilitates the scanner in detecting the edge of the document and in calibrating the document. To provide controllable color and/or texture, the reference plate 120 can be made of molded plastic.

Figure 6:
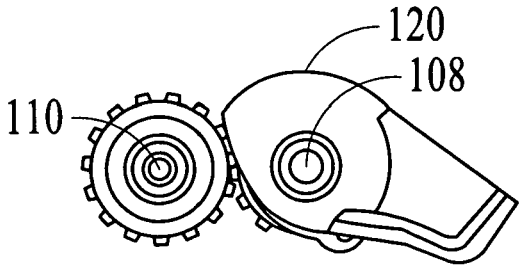
FIG. 6 is a side-view diagram of the reference plate of FIG. 2, where the reference plate is pivoted in accordance with the present invention.

Finally, the reference plate 120 is rotatably attached to the feed roll shaft so that the reference plate 120 can be pivoted away from the feed roll shaft. FIG. 6 is a side-view diagram of the reference plate 120 of FIG. 2, where the reference plate 120 is pivoted relative to the feed roll shaft 108 in accordance with the present invention. This enables a surface of the scanner behind the reference place to be conveniently cleaned without disassembly of the printer.

According to the system and method disclosed herein, the present invention provides numerous benefits. For example, it optimally integrates various printing and scanning mechanisms in a compact space by utilizing a multi-purpose reference plate. Because the reference plate has multiple functions, the cost and complexity of the printing system can be minimized.

Embodiments of the present invention also locate the reference plate 120 as close as possible to a reader of the scanner and a printhead of the printer system. This allows the entire process of scanning, decoding, and printing to be accomplished with a minimum amount of time and document motion.

A method and system has been disclosed for providing a printer system. The printer system comprises printing and scanning functions and integrates these functions by utilizing a multi-function reference plate. The printing system comprises a frame, at least one feed roll shaft coupled to the frame for feeding a document through the printer system, and a reference plate rotatably attached to the feed roll shaft. The reference plate comprises a scan surface for facilitating scanning functions and a ribbon surface for facilitating printing functions. The scan surface has a curvilinear shape and can function as a document guide during scanning. The ribbon surface also has a curvilinear shape and can function as a ribbon loading guide for printing. The reference plate utilizes a spring to ensure contact between the document and a scanner. Furthermore, the reference plate is colored and/or textured to provide a background surface that contrasts the document. The colored and/or textured background surface facilitates the scanner in detecting the edge of the document, and in calibrating the document. Finally, the reference plate is rotatably attached to the feed roll shaft so that the reference plate can be pivoted away from the feed roll shaft. This enables a surface of the scanner behind the reference place to be conveniently cleaned. As a result, printing and scanning mechanisms are optimally integrated in a compact space by utilizing a multi-purpose reference plate.

Although the present invention has been described in accordance with the embodiments shown, one of ordinary skill in the art will readily recognize that there could be variations to the embodiments, and that those variations would be within the spirit and scope of the present invention. Accordingly, many modifications may be made by one of ordinary skill in the art without departing from the spirit and scope of the appended claims.

What is claimed is:

1. A printer system comprising:

a frame;

at least one feed roll shaft coupled to the frame for feeding a document through the printer system; and a reference plate rotatably attached to the at least one feed roll shaft, the reference plate comprising:

a first surface for facilitating scanning functions; and a second surface for facilitating printing functions.

2. The system of claim 1 wherein the first surface comprises a curvilinear shape for guiding a document.

3. The system of claim 2 wherein the curvilinear shape of the first surface guides the document from a print area and into and out of a scan area.

4. The system of claim 1 wherein the second surface comprises a curvilinear shape for guiding a ribbon.

5. The system of claim 4 wherein the curvilinear shape of the second surface guides the ribbon into and out of the print area.

6. The system of claim 1 further comprising a scanner, wherein the reference plate utilizes a spring to ensure contact between the document and the scanner.

7. The system of claim 1 wherein the reference plate is colored and/or textured to provide a background surface that contrasts the document for edge detection.

8. The system of claim 1 wherein the reference plate is colored and/or textured to provide a background surface that contrasts the document for calibration of the document.

9. The system of claim 1 wherein the reference plate is molded plastic.

10. The system of claim 1 wherein the reference plate can be pivoted away from the feed roll shaft such that a surface of a scanner can be conveniently cleaned.

11. A printer system comprising:

a frame;

at least one feed roll shaft coupled to the frame for feeding a document through the printer system; and a reference plate rotatably attached to the at least one feed roll shaft, the reference plate comprising:

a first surface for facilitating scanning functions; and a second surface for facilitating printing functions, wherein the first surface comprises a curvilinear shape for guiding a document from a print area and into and out of a scan area, wherein the second surface comprises a curvilinear shape for guiding a ribbon into and out of the print area, wherein the reference plate utilizes a spring to ensure contact between the document and a scanner, wherein the reference plate is colored and/or textured to provide a background surface that contrasts the document for edge detection and for calibration of the document, and wherein the reference plate can be pivoted away from the feed roll shaft such that a surface of the scanner can be conveniently cleaned.

12. A system having printing and scanning capabilities, the system comprising:

a printer, the printer comprising at least one feed roll shaft for feeding a document through the printer;

a scanner coupled to the printer; and a reference plate rotatably attached to the at least one feed roll shaft, the reference plate comprising:

a first surface for facilitating scanning functions; and a second surface for facilitating printing functions.

13. The system of claim 12 wherein the first surface comprises a curvilinear shape for guiding a document.

14. The system of claim 13 wherein the curvilinear shape of the first surface guides the document from a print area and into and out of a scan area.

15. The system of claim 12 wherein the second surface comprises a curvilinear shape for guiding a ribbon.

16. The system of claim 15 wherein the curvilinear shape of the second surface guides the ribbon into and out of the print area.

17. The system of claim 12 wherein the reference plate utilizes a spring to ensure contact between the document and the scanner.

18. The system of claim 12 wherein the reference plate is colored and/or textured to provide a background surface that contrasts the document for edge detection.

19. The system of claim 12 wherein the reference plate is colored and/or textured to provide a background surface that contrasts the document for calibration of the document.

20. The system of claim 12 wherein the reference plate is molded plastic.

21. The system of claim 12 wherein the reference plate can be pivoted away from the feed roll shaft such that a surface of the scanner can be conveniently cleaned.

* * * * *